United States Patent [19]

Lock

[11] 3,997,068

[45] Dec. 14, 1976

[54] ASSEMBLY FOR ATTACHMENT TO EXCAVATORS

[75] Inventor: David Lock, Manchester, England

[73] Assignee: Ingersoll-Rand Company, Limited, London, England

[22] Filed: June 19, 1975

[21] Appl. No.: 588,382

[52] U.S. Cl. ..... 214/145 A; 37/103; 37/117.5; 173/29; 173/46; 299/67

[51] Int. Cl.[2] ..... E02F 3/70; E02F 3/96; B25D 17/00

[58] Field of Search ..... 37/117.5, 103, 118 R; 299/67; 214/145, 138, 145 A; 173/29, 46, 22; 175/315

[56] References Cited

UNITED STATES PATENTS

| | | | |
|---|---|---|---|
| 2,983,496 | 5/1961 | Grant | 299/67 |
| 3,596,996 | 8/1971 | Carter | 37/117.5 X |
| 3,675,349 | 7/1972 | Luck | 37/117.5 |
| 3,702,712 | 11/1972 | Cairns | 37/117.5 X |
| 3,729,844 | 5/1973 | Deglan | 37/117.5 X |
| 3,854,608 | 12/1974 | Arnold | 214/145 |
| 3,915,501 | 10/1975 | Cobb et al. | 37/117.5 X |
| 3,934,738 | 1/1976 | Arnold | 214/145 A |

FOREIGN PATENTS OR APPLICATIONS

| | | | |
|---|---|---|---|
| 466,715 | 7/1950 | Canada | 173/22 |

OTHER PUBLICATIONS

Ingersoll–Rand publication LGB 239, Mar., 1973, England.

*Primary Examiner*—Edgar S. Burr
*Assistant Examiner*—Steven A. Bratlie
*Attorney, Agent, or Firm*—Frank S. Troidl

[57] ABSTRACT

The new assembly is pivotally attached to the working arm of an excavator. The assembly includes a tool holder which is mounted in mounting brackets with the brackets being pivotally attached to the working arm of the excavator. Means are provided on the brackets for the attachment of a bucket to the mounting brackets.

1 Claim, 2 Drawing Figures

ASSEMBLY FOR ATTACHMENT TO EXCAVATORS

This invention relates to excavators. More particularly this invention is a new and improved attachment to the working arm of an excavator.

It is currently the practice when using a hydraulic excavator to use the breaker of the excavator to break up ground. After the ground has been broken up by the breaker, the breaker is then removed and replaced by a bucket, which is used to collect material which has been broken by the breaker. The exchange of the bucket for the breaker is generally time consuming and laborious since it generally involves disconnecting from the breaker and closing a number of hydraulic pipes which are used to supply pressurized fluid for the operation of the breaker and/or opening and connecting to the bucket a number of hydraulic pipes which are used to supply the pressurized fluid used to operate the bucket.

According to the present invention, an assembly is provided for pivotal attachment to the working arm of the excavator. A tool holder attaching means to which a tool holder is mounted, is pivotally attached to the working arm. Means are provided on the tool holder attachment means permitting the attachment of a bucket to the attachment means.

As stated above, the bucket is pivotally attachable to the tool holder attachment means, which may for example be brackets. Means are also provided on the bucket and tool holder for preventing the movement of the bucket with respect to the tool holder.

This means for retaining the bucket in fixed position relative to the tool holder may, for example, include a ring connected to the bucket which is adapted to fit over the breaker mounted in the tool holder; or another structure for keeping the bucket in a fixed position relative to the tool holder is to provide a male projecting member on the bucket which is adapted to fit into a bore in the tool holder.

The excavator with the bucket removed may be used with the breaker to break up the ground, and when it is desired to use the bucket all that has to be done is to connect the bucket to the tool holder bracket. The bucket is fixed relative to the tool holder by means of the ring on the bucket in one embodiment or a male projecting member on the bucket in a second embodiment.

Figure 1:
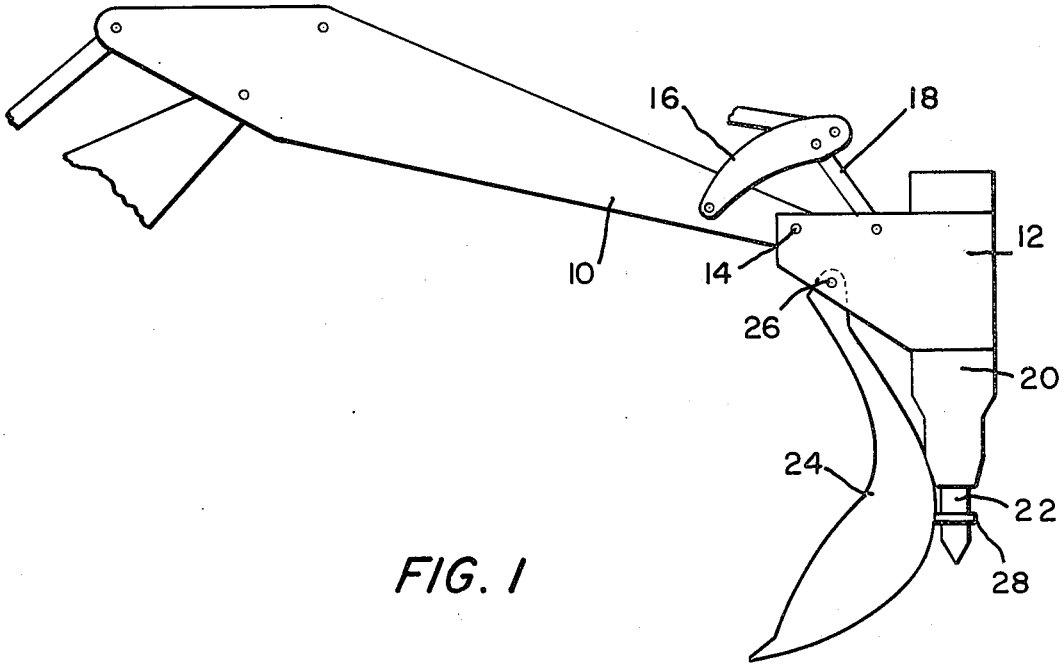
Figure 2:
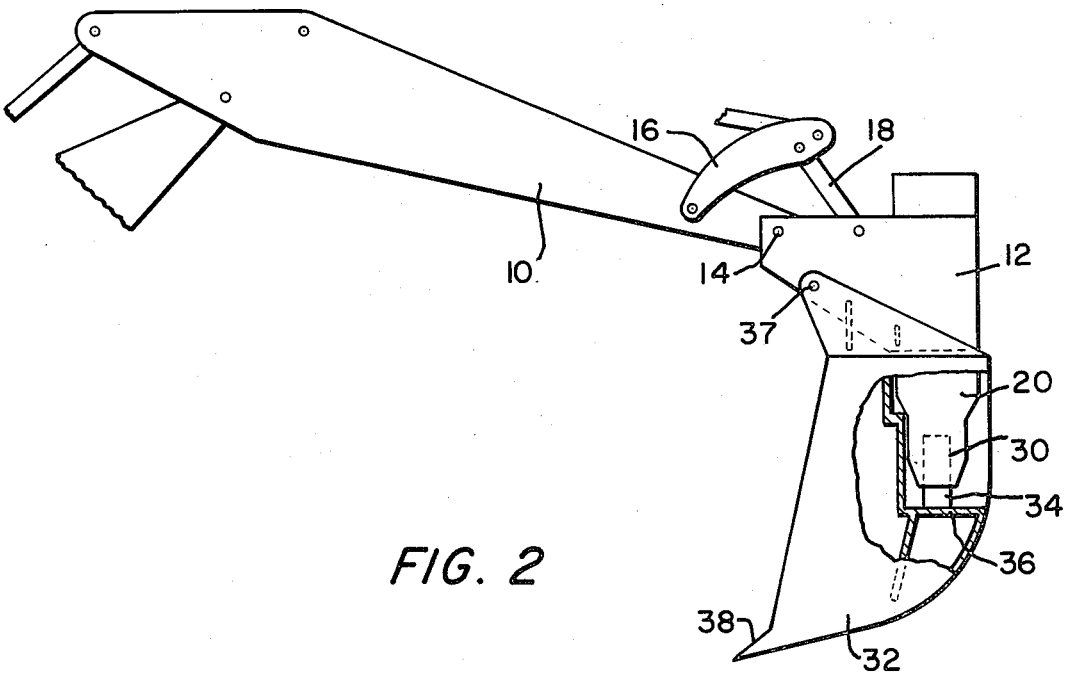

The invention as well as its many advantages may be further understood by reference to the following detailed description and drawings in which:

FIG. 1 is a side view of the working arm of a hydraulically powered excavator and showing the new assembly pivotally attached to the working arm; and FIG. 2 is a partially fragmented side view of a second embodiment of the invention.

Like parts in the figures are referred to by like numbers.

As can be seen from FIG. 1, there is shown a working arm 10 which comprises part of a hydraulic excavator. Brackets such as the bracket 12 shown in FIG. 1 are pivotally connected to the working arm 10 by a pin 14 fitting through holes appropriately located in the brackets 12 and the working arm 10. There are two spaced brackets with one bracket being shown in the Figures. The brackets 12 are pivoted about pivot pin 14 by the interconnected linkage 16 and 18, with linkage 16 being connected to the working arm 10 and linkage 18 being connected to the brackets 12. The linkage 16, 18, is hydraulically operated.

A tool holder 20 in which a tool such as a breaker 22 has been mounted is mounted on the front portion of the brackets 12. A bucket 24 is connected mechanically by a pin 26 extending through holes in the brackets 12.

When the bucket 24 is used by the excavator, the bucket must remain stationary with respect to the tool holder 20 and a ring 28 is therefore used which fits around the tool 22 and thus retains the bucket 24 in a position which is fixed relative to the tool holder 20 when the bucket is used by the excavator. Linkages 16 and 18 are operated to change the position of the bucket 24 relative to the working arm 10 when the bucket is used for scooping up material which had been previously loosened by the tool 22. This new structure permits the rapid detachment of the bucket 24 in order to permit the use of the breaker tool 22; the bucket 24, however, may be quickly attached in position relative to the tool holder 20 to permit digging and mucking by use of the bucket without the necessity to disconnect any hose.

In the embodiment shown in FIG. 2, when the bucket is to be used by the excavator rather than the breaker tool, the breaker tool is removed so that a bore 30 is left open in the tool holder 20. The bucket 32 is located in a fixed position relative to the tool holder by a replaceable male projecting portion 34 which extends into bore 30 from a platform 36, located on the closed side opposite the open side of the bucket 32. The bucket 32 is locked in position relative to the brackets 12 by means of a pin 37 extending through holes appropriately placed on the brackets 12 and also extending through holes and brackets on the bucket 32. Once the pin 37 has been removed, the male projecting member 34 can be easily removed from the bore 30 in tool holder 20. When the digging action of the bucket 32 requires assistance, the tool holder 20 can be operated as necessary to aid the cutting action. For example, when the excavator is working in sticky soil or other material which tends to cling to the bucket 32 and hang up therein when the bucket is in an unloading position, the linkage 16, 18 may be operated to shake the material free from the bucket 32.

When it is desired to use the excavator as a breaker only, without the inclusion of the bucket, it is a simple matter to remove the pin 37 and then remove the male projecting portion 34 from the tool holder 20, remove the bucket 32 and insert a breaker tool in the bore 30 of the tool holder 20.

If desired, the bucket 32 and the tool holder 20 may be pneumatically operated.

I claim:

1. An excavator comprising: a working arm; a pair of spaced brackets each having a locking pin hole adjacent the bottom thereof; means for pivotally attaching the spaced brackets to the working arm; a tool holder mounted between the spaced brackets, said tool holder extending below said spaced brackets, the tool holder having a bore extending upwardly from the bottom of the tool holder; a bucket having upwardly extending brackets, each bracket having a locking pin hole adapted to be aligned with the locking pin holes in the brackets connected to the working arm; a platform provided on the closed side of the bucket opposite the open side of the bucket; a cylindrical male projecting member on the platform and extending into the bore in the tool holder, the male projecting member having substantially the same diameter as the diameter of said bore in the tool holder, said male projecting member and said bore serving to locate the bucket in a fixed position relative to the tool holder and a locking pin extending through said bucket brackets locking pin holes, and through said locking pin holes in the spaced brackets attached to the working arm whereby the bucket may be detached without operating the means for pivotably attaching the spaced brackets to the working arm, by removing the locking pin and slidably removing the male projecting member from the bore in the tool holder.

* * * * *